United States Patent [19]

Okada

[11] Patent Number: 4,622,829

[45] Date of Patent: Nov. 18, 1986

[54] REFRIGERATING CYCLE

[75] Inventor: Tomoo Okada, Iruma, Japan

[73] Assignee: Kabushiki Kaisha Saginomiya Seisakusho, Tokyo, Japan

[21] Appl. No.: 806,771

[22] Filed: Dec. 9, 1985

[51] Int. Cl.[4] ..... F25B 41/04

[52] U.S. Cl. ..... 62/216; 62/498

[58] Field of Search ..... 62/115, 190, 216, 498

[56] References Cited

U.S. PATENT DOCUMENTS

| | | | |
|---|---|---|---|
| 2,245,454 | 6/1941 | Baker | 62/511 X |
| 2,326,093 | 8/1943 | Carter | 62/511 X |
| 2,331,264 | 10/1943 | Carter | 62/511 X |
| 3,060,699 | 10/1962 | Tilney | 62/216 X |

*Primary Examiner*—William E. Tapolcai

*Attorney, Agent, or Firm*—Lowe, Price, LeBlanc, Becker & Shur

[57] ABSTRACT

A refrigerating cycle composed of a compressor, a condenser, a pressure differential valve, a throttle, an evaporator and a check valve. The check valve is connected back to the compressor. The above mentioned pressure differential valve is divided into a valve section and a control section. The control section is further divided into two chambers by a diaphragm. Two pressure introducing tubes are connected to the pipe on the respective sides of the check valve. During operation of the refrigerating system, low pressure prevails on both side of the check valve. However, stoppage of the rotary compressor causes a high pressure refrigerant leak on the suction side thereof with the result that the high pressure refrigerant is introduced into the one of the chambers of the control section while the other pressure introducing tube on the other side of the check valve provides low pressure communication with the other chamber. Using this pressure difference, the valve section is operated by an actuator rod to close the valve, thus maintaining high pressure between the compressor and differential valve to reducing a load in resuming the operation.

6 Claims, 7 Drawing Figures

REFRIGERATING CYCLE

BACKGROUND OF THE INVENTION

The present invention relates to a refrigerating apparatus with reduced restarting load and more specifically to a refrigerator equipped with an open-close valve which rapidly closes a circuit to prevent condensed refrigerant from entering into the evaporator when the rotary compressor is stopped.

With this refrigerating apparatus, when the compressor is stopped, the pressure difference of the refrigerant or coolant before and after the compressor is balanced to block the condensed refrigerant flowing back into the evaporator, while at the same time maintaining high pressure of condensed refrigerant of the condenser so as to reduce the restarting load and thereby improve power efficiency.

It has been a common practice to provide a solenoid valve between the condenser and capillary tube with the solenoid valve opened and closed by a compressor operation signal when the compressor is started and stopped respectively. With refrigerators that are used continuously for many hours, however, it is desired not to use the solenoid valve because of a large installation space though its power consumption is small. The noise of the solenoid valve also has frequently been pointed out.

Recently, a technique has been developed to use a pressure valve in place of the solenoid valve.

FIG. 1 illustrates a refrigerating apparatus employing such a pressure valve. The apparatus consists of a rotary compressor A, a condenser B, a capillary tube C as a pressure reducing mechanism or a throttle, and an evaporator D, all these connected in series by a pipe E. A pressure differential valve $V_1$ is provided between the condenser B and the pressure reducing mechanism or throttle C with a pressure introducing tube F led from the valve $V_1$ to the suction side of the rotary compressor. A check valve $V_2$ is installed between the evaporator D and the rotary compressor A.

The detailed structure of the pressure differential valve $V_1$ is shown in FIG. 2. The valve body 1 has a primary port 2 and a secondary port 3 and also has a valve seat 4 between these ports with which a ball valve 5 is adapted to come into or out of contact. At the top of the valve body 1 are mounted upper and lower covers 6, 7 which clamp a diaphragm 8 at its periphery. Formed in the upper cover 6 is a pressure chamber with which the pressure introducing tube F communicates. A spring 10 is installed between the upper cover 6 and one side of the diaphragm 8 through a retainer 9. A valve rod 11 is abutted against the other side of the diaphragm 8 and a spring 12 is installed between the valve rod 11 and the valve body 1. A pipe $E_1$ leading from the condenser B is connected to the primary port 2 and another pipe E2 coming from the capillary tube C is connected to the secondary port 3.

Another example of the refrigerating apparatus using the pressure valve is shown in FIG. 3, in which a rotary compressor A, a condenser B, a capillary tube C and an evaporator D are connected in series by a pipe E. A pressure differential valve $V_1'$ is installed between the capillary tube C and the evaporator D. A pressure introducing tube F for the valve is connected to the suction side of the rotary compressor A. A check valve is installed between the evaporator D and rotary compressor A.

As shown in FIG. 4, the body 13 of the pressure differential valve $V_1'$ has a primary port 14 and a secondary port 15, and also has a seat 16 between the ports with which a ball valve 17 provided on the secondary port side is adapted to come into or out of contact. Mounted on top of the valve body 13 are upper and lower covers 18, 19 which hold a diaphragm 20. Formed in the upper cover 18 is a pressure chamber with which the pressure introducing tube F is communicated. A valve rod 21 is abutted against the underside of the diaphragm 20. A spring 22 is installed between the valve rod 21 and the lower cover 19. A pipe E3 from the capillary tube C is connected to the primary port 14 and another pipe E4 leading to the evaporator D is connected to the secondary port 15.

In the first example of the refrigerating apparatus, a high pressure of the condenser B is applied to the primary port of the pressure differential valve $V_1$, so that a significant amount of leak and time is necessary to obtain a sufficient force to close the valve. During this period high pressure liquid may flow into the evaporator impairing its function. The spring used to resist that high pressure must have a large spring constant. Therefore, if the pressure difference is small, the valve disk will not operate easily. Also since the high pressure varies in a wide range of 2 to 15 kg/cm$^2$G, it is difficult to set the correct valve operation range. When the spring load is large the valve closing action is quick. However, when the ambient temperature is low the condenser pressure will not increase to a level high enough to open the valve, with the result that the refrigerating apparatus cannot be operated. On the other hand, when the spring load is small and if the lead from the compressor is small when the refrigerating apparatus is stopped, the pressure in the pressure introducing tube F will not increase sifficiently rapidly so that the valve will not close letting the high pressure liquid flow into the evaporator.

The second example of the refrigerating apparatus makes use of the fact that the pressure of the evaporator does not change greatly when the refrigerating apparatus is stopped or started. When the rotary compressor is stopped, the pressure differential valve is operated by the pressure difference between the leak from the rotary compressor and the evaporator pressure in order to quickly block the high pressure liquid flowing into the evaporator.

However, the refrigerating apparatus in which the pressure differential valve is installled downstream of the pressure reducing mechanism or a trottle C consisting of a capillary tube has the following drawbacks. With the refrigerator, it is necessary to install the pressure differential valve inside the refrigerator box to prevent formation of dew and frost as well as deteriorated freezing efficiency. This makes small the space inside the box and also makes the assembly work difficult. With the air conditioner, the rotary compressor and condenser are installed outside the room and the pressure reducing mechanism and evaporator installed inside the room. This requires two pipes for connecting the indoor and outdoor equipment and also a third pipe, a pressure introducing tube F which connects the pressure differential valve $V_1'$, interposed between the pressure reducing mechanism C and evaporator D, to the suction side of the rotary compressor A.

SUMMARY OF THE INVENTION

This invention has been accomplished to overcome the above drawbacks-one of which is the inadequate operation of the pressure differential valve associated with the spring constant as experienced with the first example and another is increased number of pipes for connecting the indoor and outdoor equipment as encountered in the second example. The invention makes use of the fact that there is little pressure difference before and after the check valve interposed between the rotary compressor and the evaporator during operation but that the pressure difference rapidly increases due to leak from the compressor when the rotary compressor is stopped. In other words, it is the object of the invention to provided a refrigerating apparatus which can safely prevent the high pressure liquid from flowing into the evaporator when stopping the compressor, by cnstructing the pressure differential valve so that it can reliably operate quickly based on the above check valve pressure difference characteristic.

DETAILED DESCRIPTION OF EMBODIMENTS

Now, in the following detailed description will be given to one embodiment of this invention.

Figure 1:
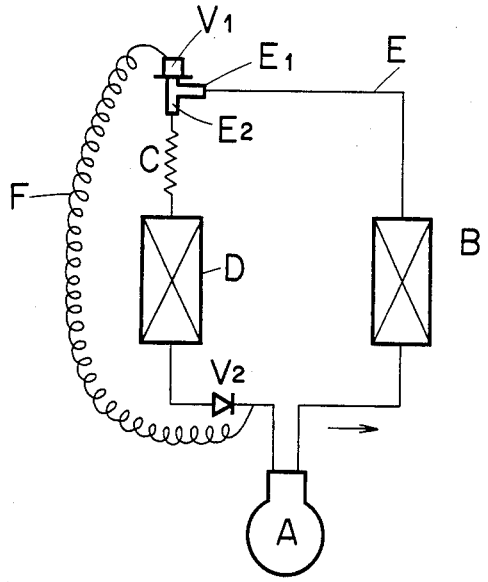
FIG. 1 Prior art
FIG. 1 is an explanatory drawing of a conventional refrigerating system wherein one type of a pressure differential valve is used.
Figure 3:
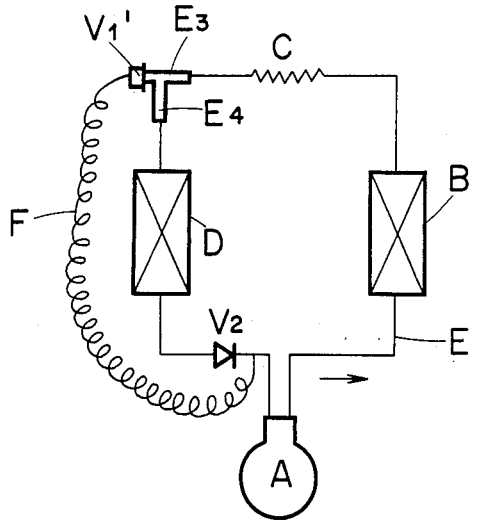
FIG. 3 Prior art
FIG. 3 is an explanatory drawing of another conventional refrigerating system wherein another type of pressure differential valve is used.
Figure 2:
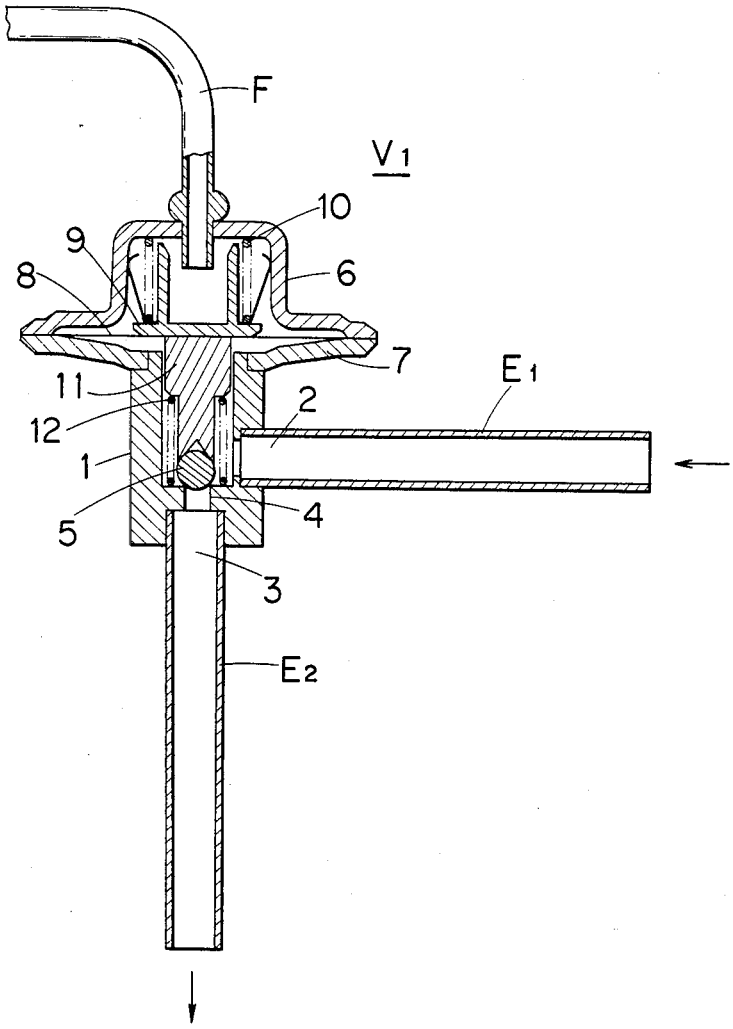
FIG. 2 Prior art
FIG. 2 is an enlarged cross section of the pressure differential valve of FIG. 1.
Figure 4:
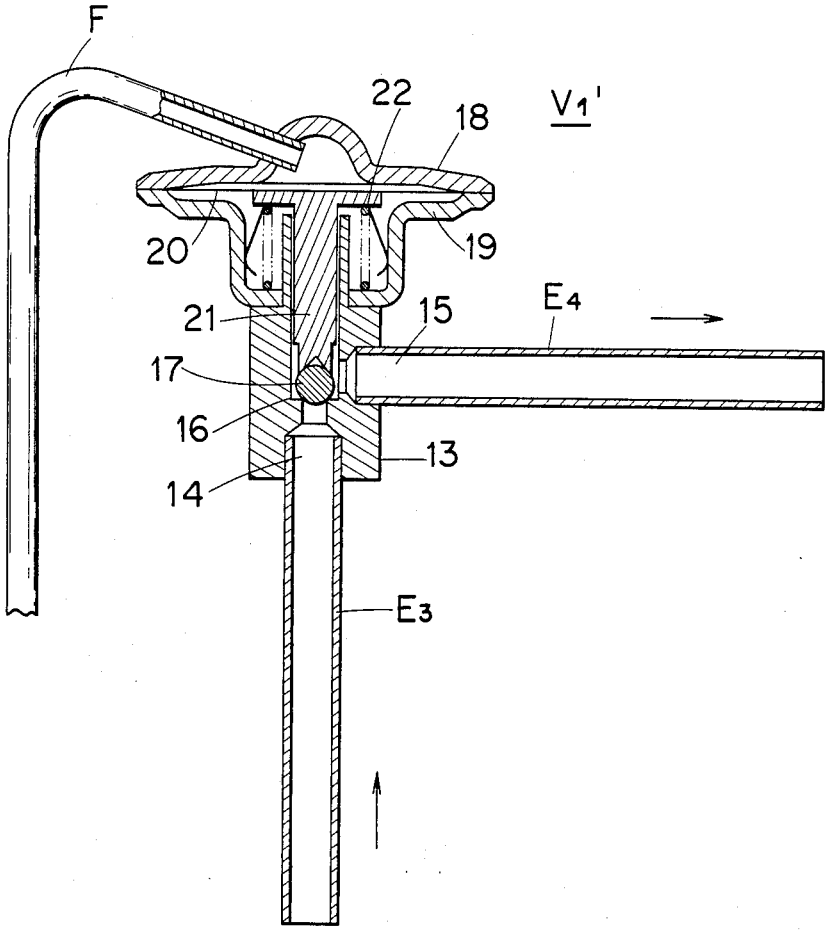
FIG. 4 Prior art
FIG. 4 is an enlarged cross section of the pressure differential valve of FIG. 3.
Figure 5:
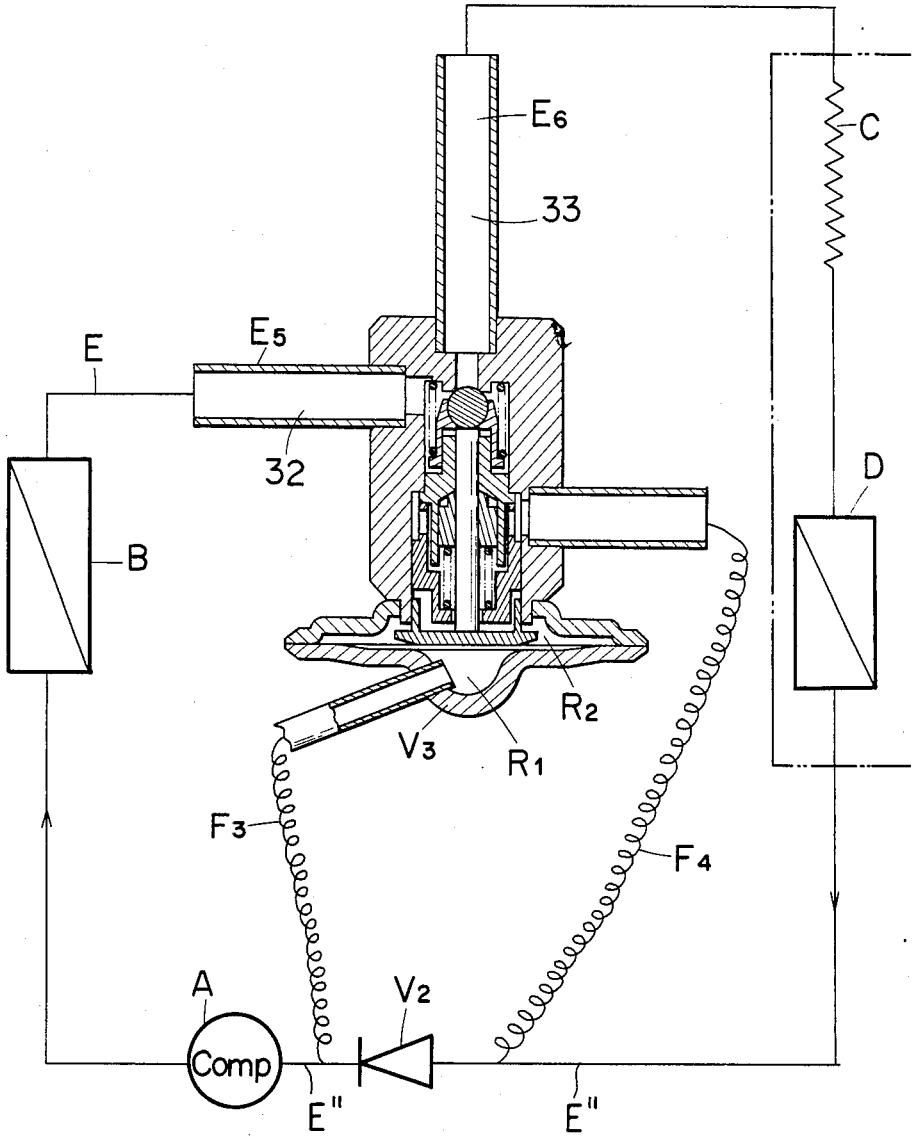
FIG. 5 is an explanatory of a refrigerating system of the present invention wherein a new type of pressure differential valve is used.

Referring to FIG. 5, a rotary compressor A, a condenser B, a capillary tube C and an evaporator D are connected in series by a pipe E, said rotary compressor has a delivery port and a suction port, said delivery port being connected to the condenser by means of a delivery pipe E′, said suction port being connected to the evaporator by means of a suction pipe E″. A pressure differential valve $V_3$ is installed between the condenser B and the capillary tube C. A check valve $V_2$ is provided in said series connection between the evaporator D and rotary compressor A. A first pressure introducing tube $F_3$ connected to the suction pipe E″ on the compressor side of the check valve $V_2$ is led to a first chamber, which will be explained later on, of the pressure differential valve $V_3$. A second pressure introducing tube $F_4$ connected to said suction pipe E″ on the evaporator side of the check valve $V_2$ is connected to a second chamber, which will be explained later on, of the pressure differential valve $V_3$.

Figure 6:
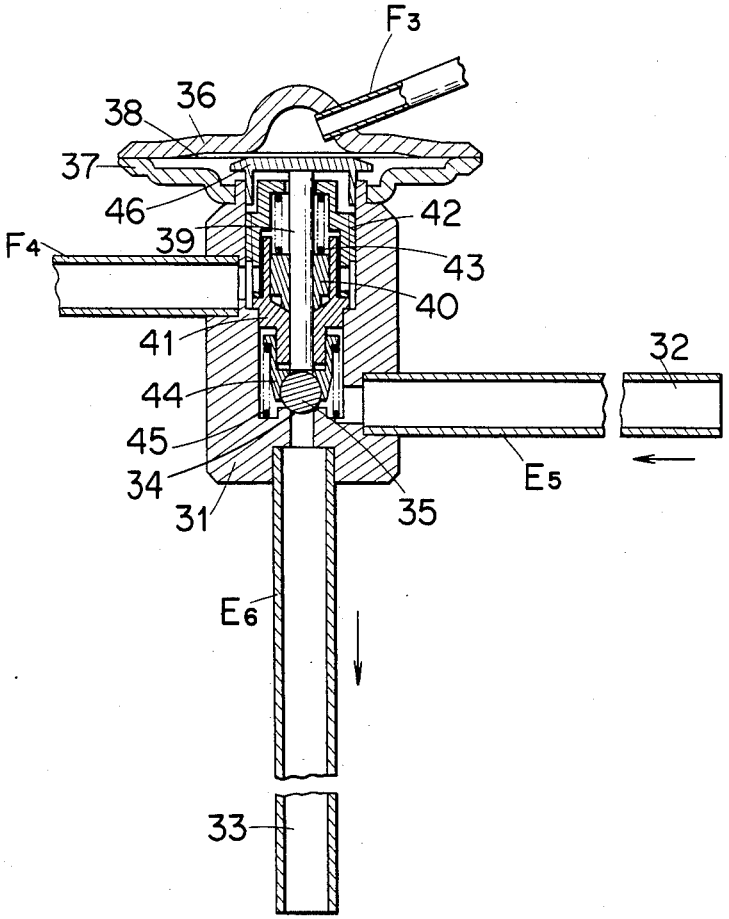
FIG. 6 is a cross section of the pressure differential valve of FIG. 5.

The pressure differential valve $V_3$ is shown in detail in FIG. 6. The bronze body 31 of the valve $V_3$ has a primary and secondary ports 32 and 33. The body also has a valve seat 34 formed between the ports with which a stainless steel ball valve 35 is adapted to come into and out of contact. Formed at the top of the valve body 31 are upper and lower covers 36 and 37 which support a diaphragm 38 by clamping the periphery thereof thus defining first and second chambers $R_1$ and $R_2$. The pressure introducing tube $F_3$ is communicated with the first chamber defined by said upper cover 36. A stainless steel valve rod 39 is abutted against the underside of the diaphragm 38 through the bronze abutment member 46. A stainless spring 45 is interposed between the valve rod 39 and the valve body 31. In the example shown, a spring retainer 44 formed of bronze attached to the lower end of the valve rod 39 holds the spring 45 in position and embraces the ball valve 35 therein. The valve rod 39 passes through the bronze packing guide 41 provided between it and the valve body 31 and is sealed by a seal packing member 40 of polytetrafluoroethylene.

A bronze packing bolt 42 is tapped therearound and screwed into the valve body 31 in position. The pressure introducing tube $F_4$ is communicated with the second chamber $R_2$ in the lower cover 37 on the underside of the diaphragm 38. The primary port 32 is connected with a pipe $E_5$ coming from the condenser B and the secondary port 33 with a pipe $E_6$ from the capillary tube C.

Figure 7:
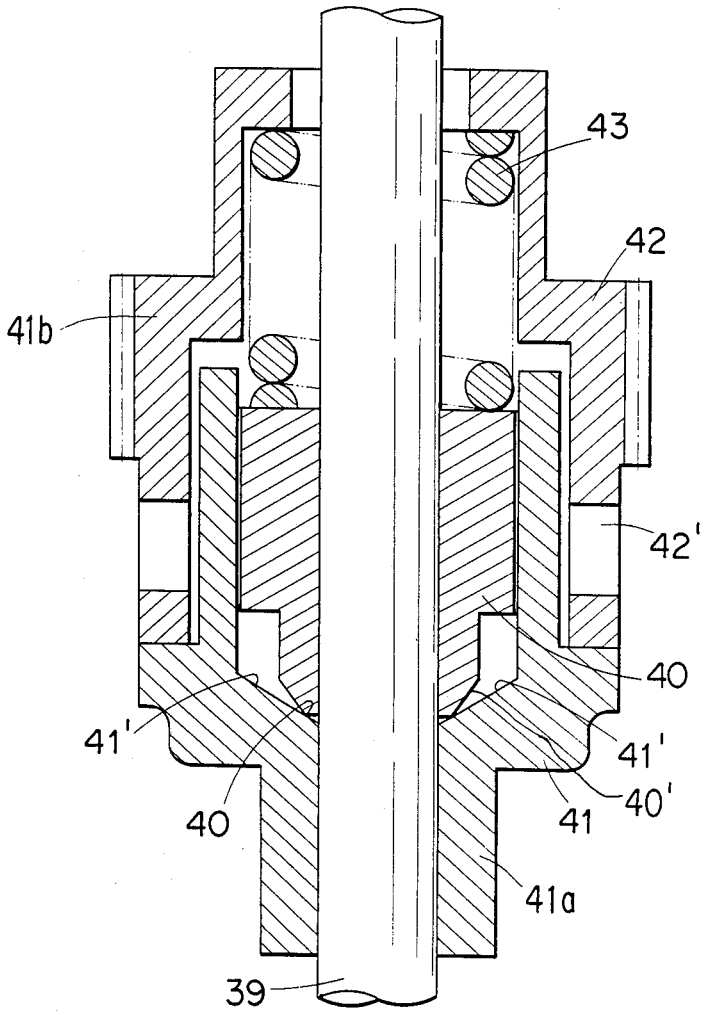
FIG. 7 is an enlarged cross section of the pressure differential valve of FIG. 6.

Referring to FIG. 7, seal mechanism will be described. Said packing guide 41 has a boss section 41*a* and a tubular section 41*b* and is accommodated in the valve body 31. Said valve body 31 has a shouldered portion in the inner wall thereof with which the tubular portion 41*b* of the packing guide 41 is engaged. Further, said boss section 41*a* is formed with a throughbore for slidably supporting the actuator rod 39 therethrough. On the other hand, said tubular section 41*b* has an elongated annular wall and conical wall 41′ sloping toward said throughbore. Said annular wall defines an annular space in cooperation with the actuator rod 39 and opens into the control section.

Said packing member 40 is received in said annular space to surround the actuator rod 39. Since the packing bolt 42 is screwed into the valve body 31, it depresses the packing guide 41 downward until it abuts against the shouldered portion of valve body 31, thus securing the packing guide 41 in position within the valve body 31. Further, compression spring 43 is provided between the packing bolt 41 and the packing member 40 to urge the same against the conical wall 41′ under the force of about 2 kg.

Said packing member 40 has a truncated conical end wherein its conical surface extends at an angle of about 40 degrees with respect to the actuator rod 39 whereas a truncated top surface extends at a right angle with respect to the actuating rod, thus forming a circular ridge 40′ to contact the conical slope of the packing guide 41. Sliding friction between stainless steel valve rod 39 and packing member 40 of polytetrafluoroethylene is negligible ranging from 100 to 200 grams. The sloping surface 41′ of the packing guide 41 is 60 degrees with respect to the actuator rod 39.

Because of the relationship between the ridge and slope, the sealing effect between the control section and valve section of the pressure differential valve is greatly enhanced.

In the above construction, during operation of the rotary compressor A, the pressures before and after the check valve $V_2$ are almost equal and small. These pressures are led to each side of the diaphragm 38 and the action of the spring 45 causes the ball valve 35 to part from the valve seat 34, permitting the refrigerant to flow into the capillary tube C.

Next, when the rotary compressor A is stopped, the high pressure on the delivery side leaks to the suction side, so that the pressure on the suction side increases. However, pressure leak to the suction side is immediately blocked by the check valve $V_2$ and the high pressure is led, through the pressure introducing tube $F_3$, to the upper side of the diaphragm 38. This pushes down the ball valve 35 against the sum force of the low pressure at the underside of the diaphragm and the spring 45, thereby closing the valve seat 34 and blocking the flow of refrigerant into the capillary tube C.

To summarize, the refrigerating apparatus of the invention has the following advantages: it can open the refrigerant path with a small spring load when the rotary compressor is started and rapidly close the path, when the compressor is stopped, by the leaking pressure from the rotary compressor thereby blocking the flow of high pressure liquid into the evaporator.

The connection between the indoor equipment consisting of capillary tube and evaporator and the outdoor equipment consisting of rotary compressor and condenser can be accomplished by only two refrigerant pipes since there is no need for a pressure introducing tube to connect the indoor and outdoor equipment.

Furthermore, since the differential pressure valve's diaphragm actuating system is separated from the refrigerant passage, there is no pipe resistance loss. The high pressure of the refrigerant is sealed by the seal packing.

What is claimed is:

1. A refrigerating system comprising a condenser and an evaporator connected in series with each other;

throttle means provided in said series connection between said condenser and said evaporator;

a rotary compressor having a delivery port and a suction port, said delivery port being connected to the condenser by means of a delivery tube, said suction port being connected to the evaporator by means of a suction tube;

a check valve provided in said suction tube;

differential pressure valve provided between said throttle means and said condenser in said series connection, said differential pressure valve having an elongated space therein including a valve section and a control section, said control section being divided by a diaphragm into first and second chambers;

a first pressure introducing tube communicating said first chamber with said suction tube on the compressor side of the check valve; and a second pressure introducing tube communicating said second chamber with said suction tube on the evaporator side of the check valve;

said differential pressure valve including valve means provided within said valve section thereof, said valve section being formed with a primary port communicating with the condenser and a secondary port communicating with the evaporator via the throttle means, said valve means being adapted to open or block communication between said primary port and said secondary port; actuator means connecting said diaphragm and said valve means and normally urged to maintain said valve means at an open position; and seal means for providing seal between said control section and said the valve section.

2. A refrigerating system according to claim 1, wherein said valve means includes a valve seat formed in the secondary port of the valve section and a ball valve adapted to be nested in said valve seat.

3. A refrigerating system according to claim 1, wherein said actuator means includes an actuator rod and an abutment member attached at a first end thereof, a spring retainer attached to a second end of the actuator rod, said abutment member being abutting against the diaphragm, said spring retainer holding said ball valve.

4. A refrigerating system according to claim 1, wherein said seal means includes a packing guide having a boss section and a tubular section continuous thereto, said boss section being formed with a throughbore for slidably supporting the actuator rod therethrough, said tubular section having an elongated annular wall and a conical wall continuous thereto and sloping toward the throughhole, said elongated annular wall defining an annular space in cooperation with the actuator rod, said annular space opening into the control section; and a packing member received in said annular space to surround the actuator rod, said packing member being urged toward said conical wall.

5. A refrigerating system according to claim 4, wherein said packing member has a circular ridge to contact said conical slope of the packing guide.

6. A refrigerating system according to claim 5, wherein said packing member is of polytetrafluoroethylene, the actuator rod being of stainless steel, said packing guide being of bronze.

* * * * *